United States Patent [19]

Murnane

[11] Patent Number: 4,967,973

[45] Date of Patent: Nov. 6, 1990

[54] WIRE DISPENSING MACHINES

[76] Inventor: Gerard P. Murnane, Iolair Bhana, Killarney Road, Macroom, County Cork, Ireland

[21] Appl. No.: 351,776

[22] Filed: May 12, 1989

Related U.S. Application Data

[63] Continuation-in-part of Ser. No. 178,753, Apr. 4, 1988, abandoned, which is a continuation of Ser. No. 845,602, Mar. 28, 1986, abandoned.

[30] Foreign Application Priority Data

Mar. 29, 1985 [IE] Ireland ..... 808/85

[51] Int. Cl.[5] ..... B65H 59/38; B65H 54/04; B65H 57/28; B65H 49/18

[52] U.S. Cl. ..... 242/45; 242/54 R; 242/78; 242/129.6; 242/157.1

[58] Field of Search ..... 242/45, 54 R, 58.6, 242/25 R, 75.5, 75.51, 78, 129.6, 129.51, 157.1

[56] References Cited

U.S. PATENT DOCUMENTS

| | | | |
|---|---|---|---|
| 2,243,624 | 5/1941 | Gazet | 242/157.1 |
| 2,400,739 | 5/1946 | Burge | 242/54 R |
| 2,571,243 | 10/1951 | Hooker | 242/45 X |
| 2,575,062 | 11/1951 | Merwin | 242/129.6 |
| 2,640,655 | 6/1953 | Johnson | 242/45 |
| 2,650,771 | 9/1953 | Marion | 242/54 R |
| 2,914,262 | 11/1959 | Ludvigsen | 242/45 |
| 2,981,491 | 4/1961 | Eans, Jr. | 242/45 |
| 2,984,429 | 5/1961 | Huck | 242/58.6 X |
| 3,233,397 | 2/1966 | Bonikowski | 242/45 |
| 3,325,118 | 6/1967 | Hall | 242/58.6 X |
| 3,371,878 | 3/1968 | Garner | 242/45 |
| 3,537,660 | 11/1970 | Schippers et al. | 242/45 |
| 3,670,975 | 6/1972 | Tomimatsu | 242/45 |
| 4,046,331 | 9/1977 | Decker, Sr. | 242/54 R |
| 4,353,515 | 10/1982 | Weaver et al. | 242/129.6 X |
| 4,530,471 | 7/1985 | Inoue | 242/45 |
| 4,566,646 | 1/1986 | Benjamin | 242/45 |

FOREIGN PATENT DOCUMENTS

| | | | |
|---|---|---|---|
| 0061975 | 10/1982 | European Pat. Off. | 242/45 |
| 668554 | 12/1938 | Fed. Rep. of Germany . | |
| 852978 | 10/1952 | Fed. Rep. of Germany . | |
| 2545464 | 11/1984 | France . | |
| 158540 | 1/1983 | German Democratic Rep. . | |
| 526862 | 9/1940 | United Kingdom | 242/157.1 |

*Primary Examiner*—Stanley N. Gilreath
*Attorney, Agent, or Firm*—Scully, Scott, Murphy & Presser

[57] ABSTRACT

An apparatus for the spooling, storage and dispensing of reels of wire in which thre is provided means for measuring the pulling force on the wire so that the speed of rotation of the reel is in proportion to this pulling force. In one embodiment this comprises three pulleys, two fixed and the third movable towards and away from an in-line position between the pulleys under the influence of the tension imparted to the wire. The movable pulley is connected to a potentiometer which controls the speed of an electric motor used to drive the reel.

4 Claims, 14 Drawing Sheets

WIRE DISPENSING MACHINES

This patent application is a continuation-in-part of U.S. Ser. No. 178,753 filed Apr. 4, 1988, now abandoned, which is a continuation of U.S. Ser. No. 845,602 filed Mar. 28, 1986, now abandoned.

BACKGROUND OF THE INVENTION

1. Introduction

The present invention relates to the spooling, storage and dispensing of reels.

Drums, bobbins, spools and reels are used extensively for the storage of thread, wire, hose, carpet, wrapping sheets and other material and items that are wound on them. Generally speaking, the term "spooling" is used for the wrapping of material onto a drum or reel and the paying out is often called "de-reeling" or "dispensing". For simplicity in this specification the term "spooling" and "dispensing" will be used and the storage apparatus and goods will generally be hereinafter referred to respectively as "reels" and "wire". It should however, be appreciated that while the invention is described with particular reference to the unwinding of wire from a reel it is not limited to this.

There are many devices for spooling, storage and dispensing of reels which generally consist of some form of reel support, a reel rotation drive and speed variation means for altering the speed of rotation of the reel. Generally speaking this speed variation is carried out by some form of control unit on the reel rotation drive.

2. Field of the Invention

One of the major problems with wire reel spooling, storage and dispensing devices is that they very often break the wire when spooling, if the operation does not go completely smoothly. Similarly, when dispensing wire they tend to dispense too much wire, thus causing difficulties. The problem is that essentially in any unwinding operation it is necessary that only length of sufficient wire is pulled from the reel as is required or where the reel is independently driven that the reel be stopped immediately after a sufficient length of wire has been supplied. This unfortunately is not what happens in practice and there is not in known devices an instant response to demand. Indeed, in known devices this is often provided by the use of some form of brake which is unsatisfactory.

OBJECTS

The present invention is directed towards providing a wire reel spooling, storage and dispensing device which will be more efficient in use than those heretofore known.

Another object of the invention is to provide a wire reel spooling, storage and dispensing device in which there will be an instant response to demand.

Another object of the invention is to provide a wire reel spooling, storage and dispensing device which on spooling will stop immediately if there is more than a preset tension exerted on the wire.

SUMMARY OF THE INVENTION

The invention provides a wire reel spooling, storage and dispensing device comprising;

a support frame structure;

a wire reel support comprising a pair of spaced-apart arms each pivotally mounted at one end on the support frame structure and at the other end adapted for support of a wire reel therebetween;

means for raising and lowering the arms relative to the frame structure;

a variable speed reel rotation drive;

means for measuring a pulling force exerted on the wire, comprising a fixed wire input guide pulley, a fixed wire output guide pulley and a movable intermediate guide pulley therebetween, offset from an in-line position as defined by a wire running directly between the two fixed pulleys, and means for biasing the intermediate guide pulley away from the in-line position between the input and the output guide pulleys against any tension in the wire which will cause the intermediate guide pulley to move towards the in-line position;

means for varying the speed of the reel rotation drive in response to the pulling force, said means being controlled by movement of the intermediate guide pulley; and a wire reel spooling guide mounted on the support frame structure between the means for measuring a pulling force exerted on the wire and the wire reel support, the spooling guide for use when spooling wire onto a reel mounted on the reel support.

The device according to the invention is characterised in that the reel rotation drive is reversible to facilitate both spooling wire onto and dispensing wire from a reel when the reel is mounted on the reel support. The invention thus provides a wire reel spooling, storage and dispensing device which can perform the dual function of both spooling and dispensing wire. The device according to the invention is further characterised in that the spooling guide has a pair of spaced-apart guide wheels for feeding wire onto a reel when spooling, the guide wheels being mounted on a cantilevered support arm, the support arm being mounted on the support frame structure by flexible connection means which comprises a pair of spaced-apart plates, namely a mounting plate secured to the support frame structure and an outer plate connected to the support arm, a universal joint and a pair of spaced-apart springs connecting said plates whereby the support arm is permitted limited movement to follow spooling of wire. This arrangement of spooling guide is particularly advantageous as it ensures that as wire is being spooled onto a reel the wire is coiled in an even and tightly packed manner on the reel. Further the arrangement of the spooling guide enables the device to spool effectively even if during use it is subjected to relatively heavy vibrations or transmitted shock.

A further advantage of the wire reel spooling, storage, and dispensing device according to the invention lies in the arrangement of the wire reel support. This will accommodate a wide range of sizes and constructions of reel which can be quickly and easily mounted and dismounted from the wire reel support.

The wire reel spooling, storage and dispensing device of the invention also readily easily accommodates a wide range of wire sizes.

DETAILED DESCRIPTION OF THE INVENTION

Figure 1:
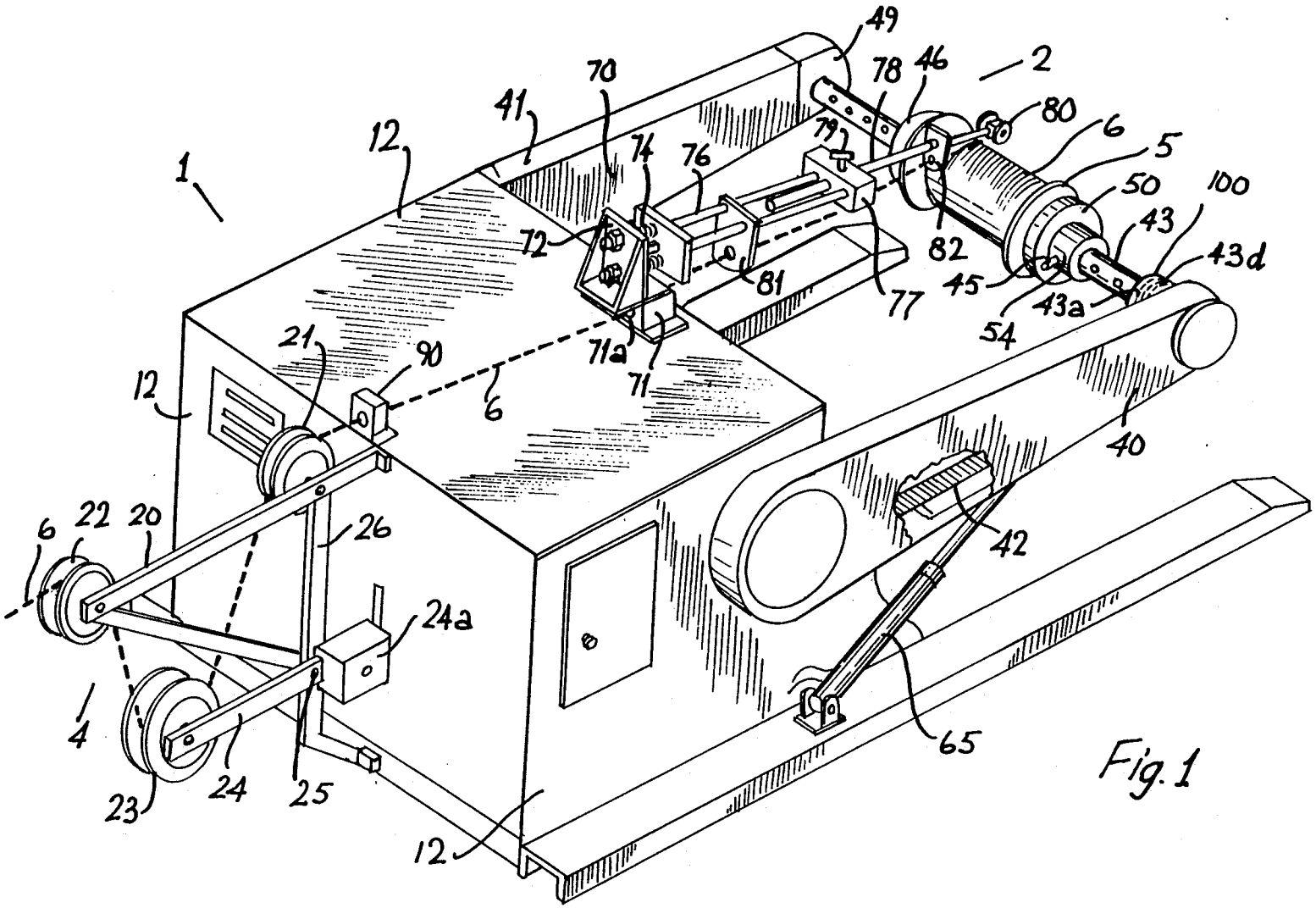
FIG. 1 is a perspective part cut-away view of a device according to the invention.
Figure 2:
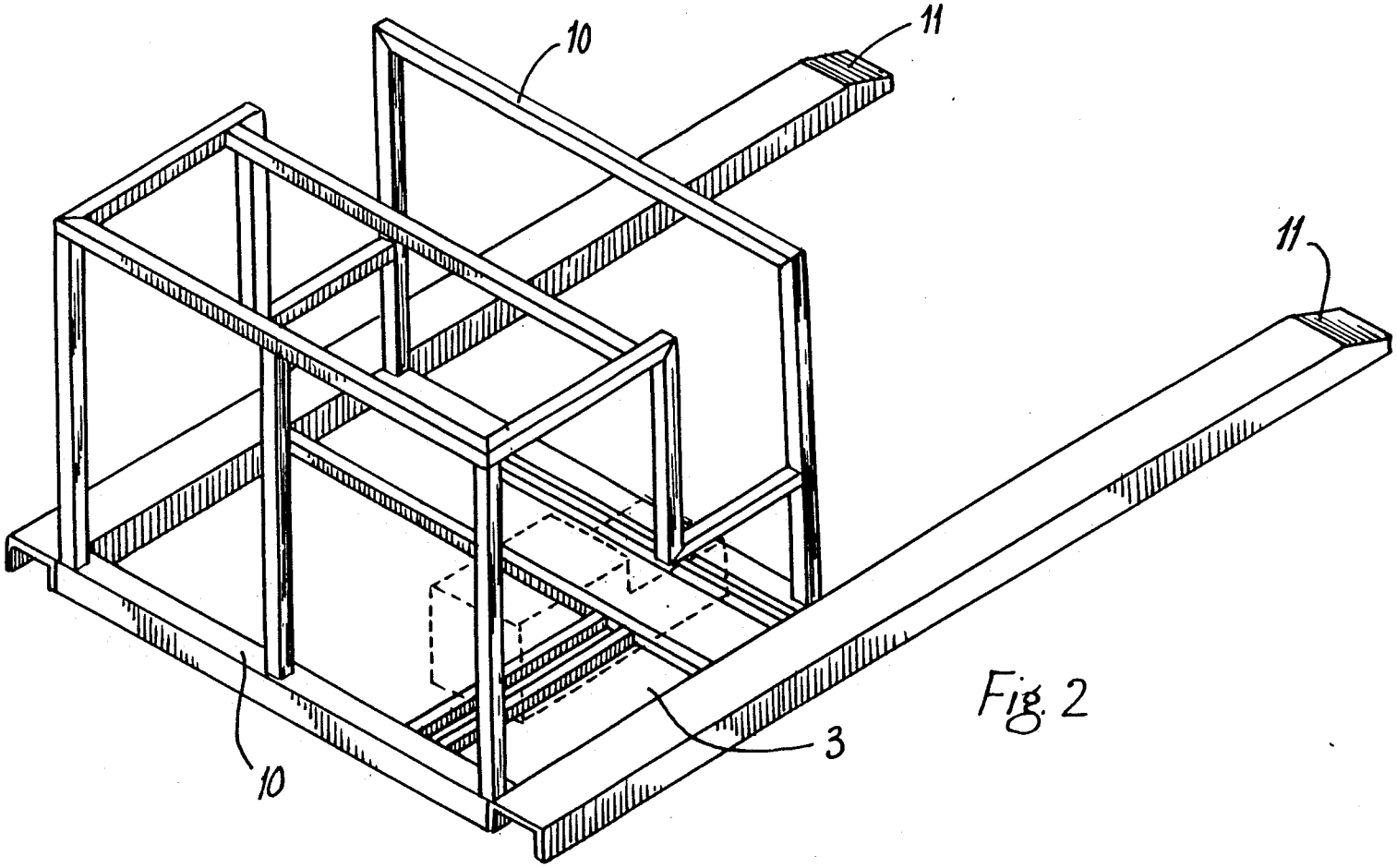
FIG. 2 is a perspective view of the support framework of the device.
Figure 4:
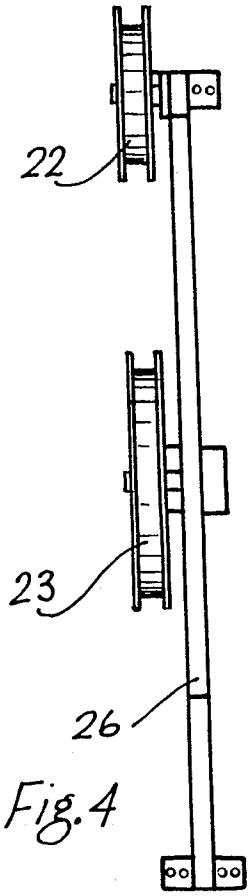
FIG. 4 is an end view of the portion illustrated in FIG. 3.
Figure 3:
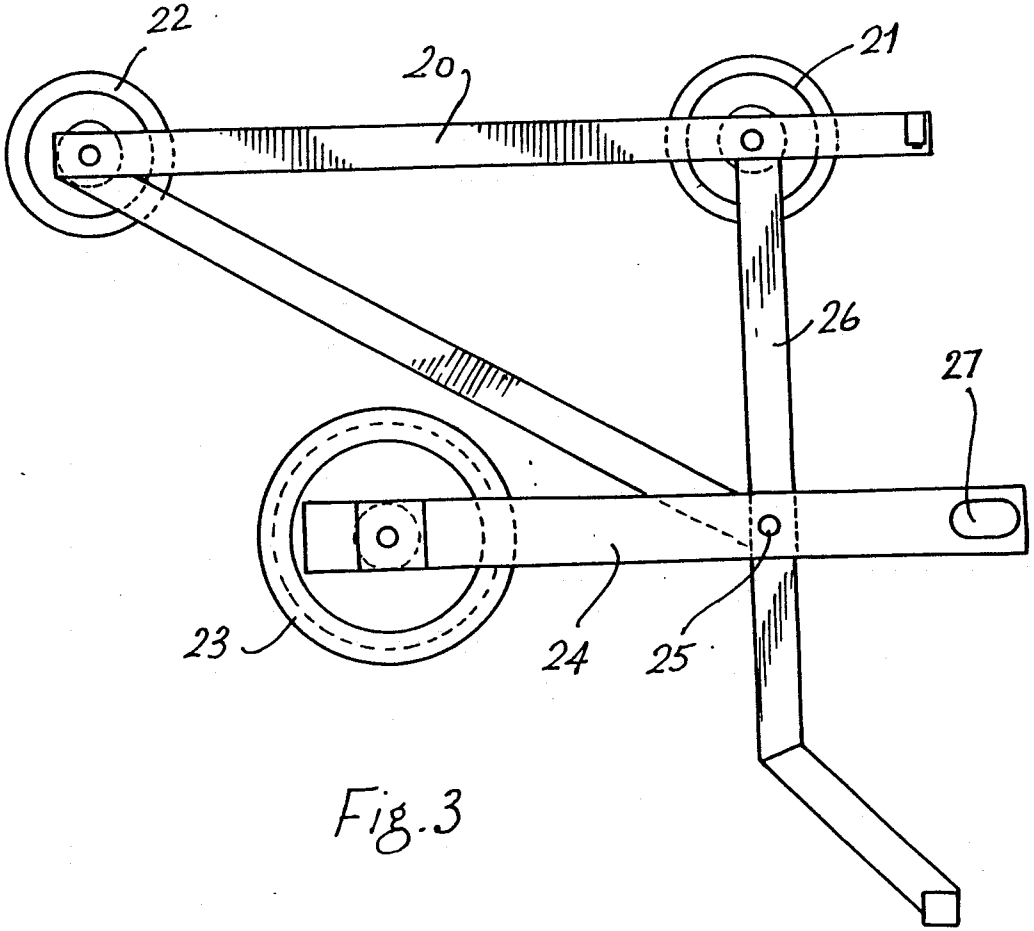
FIG. 3 is a side view of a portion of the device.
Figure 5:
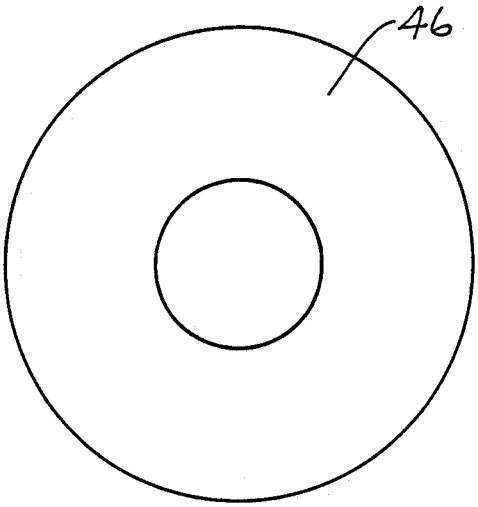
FIG. 5 is an end view of a cone forming a portion of a reel support.
Figure 6:
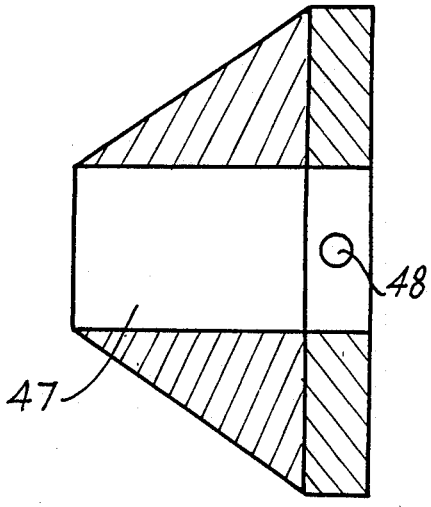
FIG. 6 is a sectional view of the cone illustrated in FIG. 5.
Figure 7:
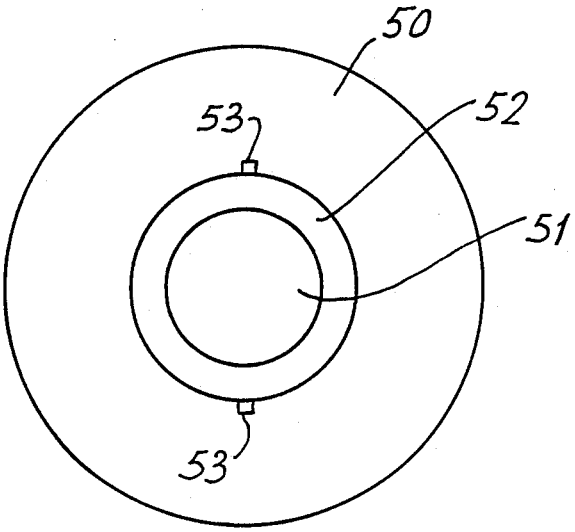
FIG. 7 is an end view of another cone used in the reel support.
Figure 8:
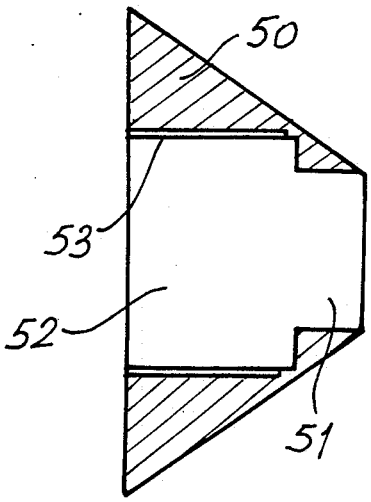
FIG. 8 is a typical cross-sectional view of the cone of FIG. 7.
Figure 9:
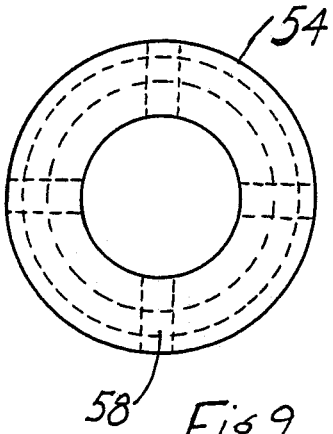
FIG. 9 is an end view of an adjustment screw used with the cone of FIG. 7.
Figure 10:
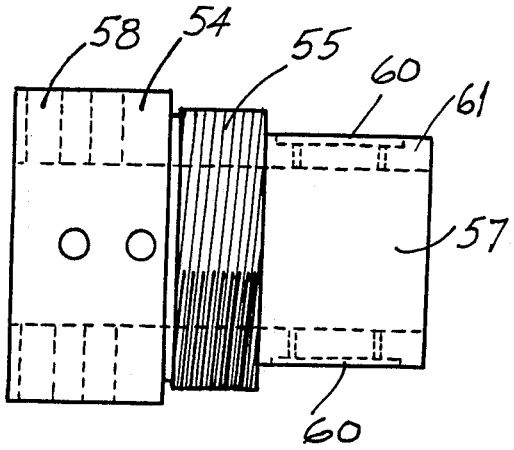
FIG. 10 is a side view of the adjustment screw.
Figure 12:
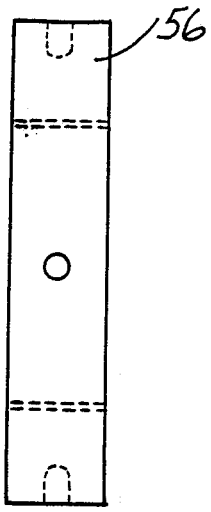
FIG. 12 is a side view of the locking nut.
Figure 11:
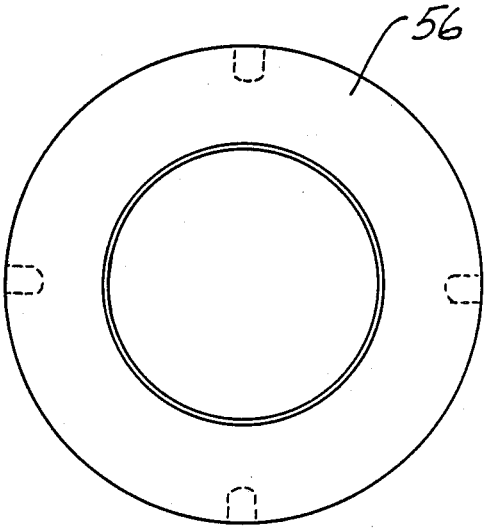
FIG. 11 is an end view of a locking nut for the adjustment screw.
Figure 13:
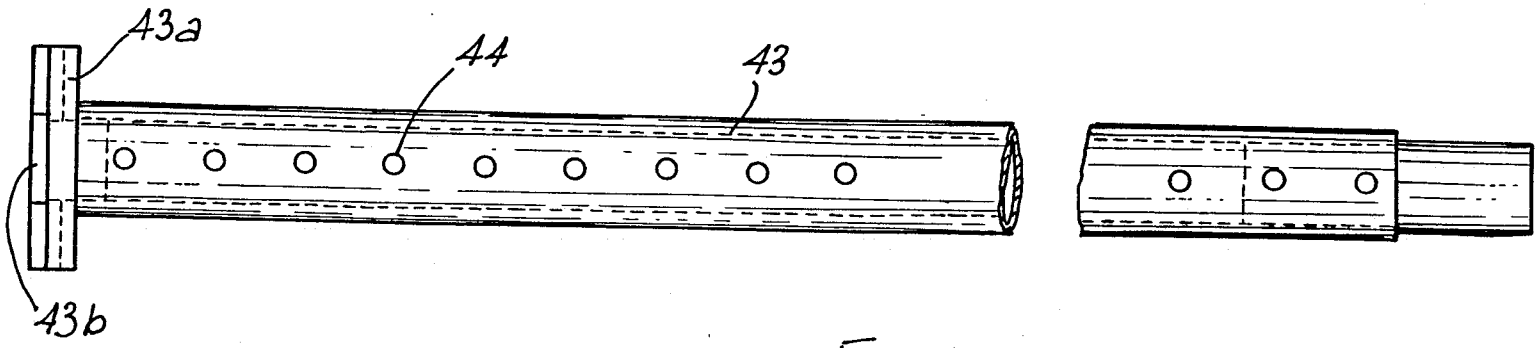
FIG. 13 is a side view of a reel support shaft according to the invention.

Referring to the drawings and initially to FIGS. 1 to 18 thereof there is illustrated a wire reel spooling, storage and dispensing device indicated generally by the reference numeral 1 comprising a wire reel support indicated generally by the reference numeral 2, a variable speed reel rotation drive indicated generally by the reference numeral 3 hidden within the device and not illustrated except by interrupted lines in FIG. 2 and means for measuring the pulling force exerted on the wire indicated generally by the reference 4. In FIG. 1 a wire reel 5 is shown mounted on the reel support 2, the wire reel 5 having wire 6 wound thereon.

The device includes a support frame structure 10 (see FIG. 2) mounted on a pair of ground engaging skids 11; the support frame structure 10 is covered by panels 12. The pulling force measuring means 4 which is illustrated in detail in FIGS. 3 and 4 comprises a support arm 20 on which is mounted a fixed wire input guide formed from a pulley 21 and an in-line fixed wire output guide pulley 22 and a movable intermediate guide pulley 23 offset from an in-line position as defined by a wire running directly between the two fixed pulleys 21, 22. This intermediate guide pulley 23 is mounted on an arm 24 which incorporates an adjustable counterweight 24*a* and is pivoted at 25 on an upright support 26. The weight of the pulley 23 tends to pivot the arm 24 biassing the intermediate guide pulley 23 away from the in-line position between the input and output guide pulleys 21, 22 against any tension in the wire 6 which will cause the intermediate guide pulley 23 to move towards the in-line positions. Movement of the counter weight 24*a* along the arm 24 allows adjustment of the downward bias on the intermediate guide pulley 23. The other end of the arm 24 has a slot 27 for connection to a potentiometer.

Figure 17:
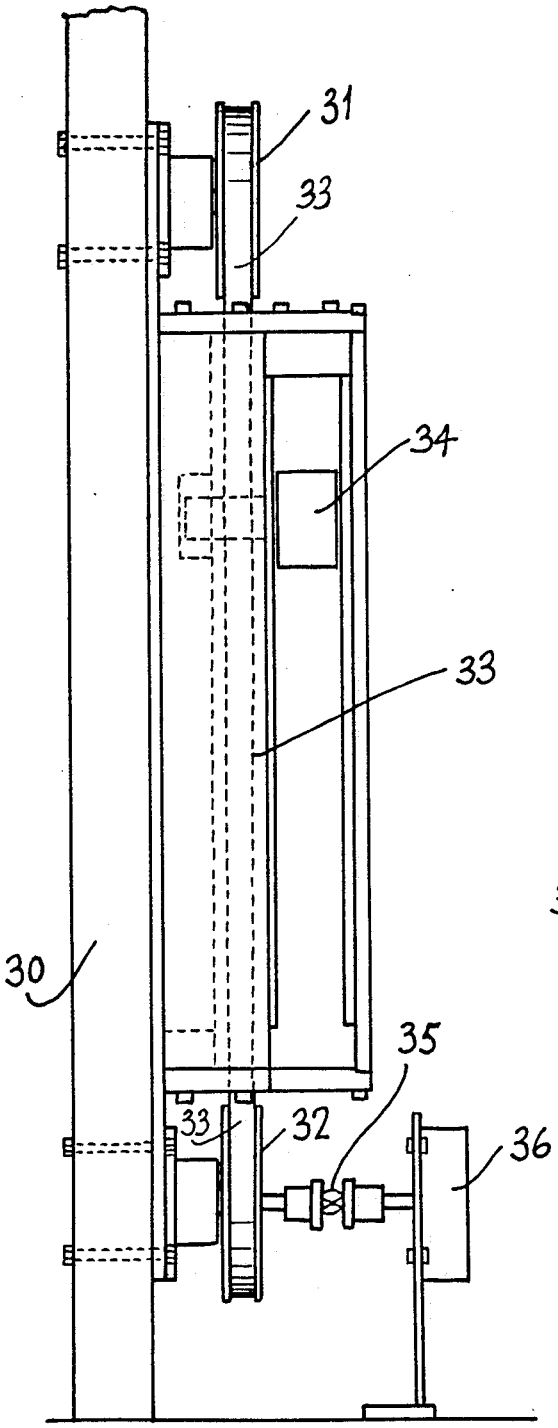
FIG. 17 is a side view of a potentiometer assembly used in accordance with the invention.
Figure 18:
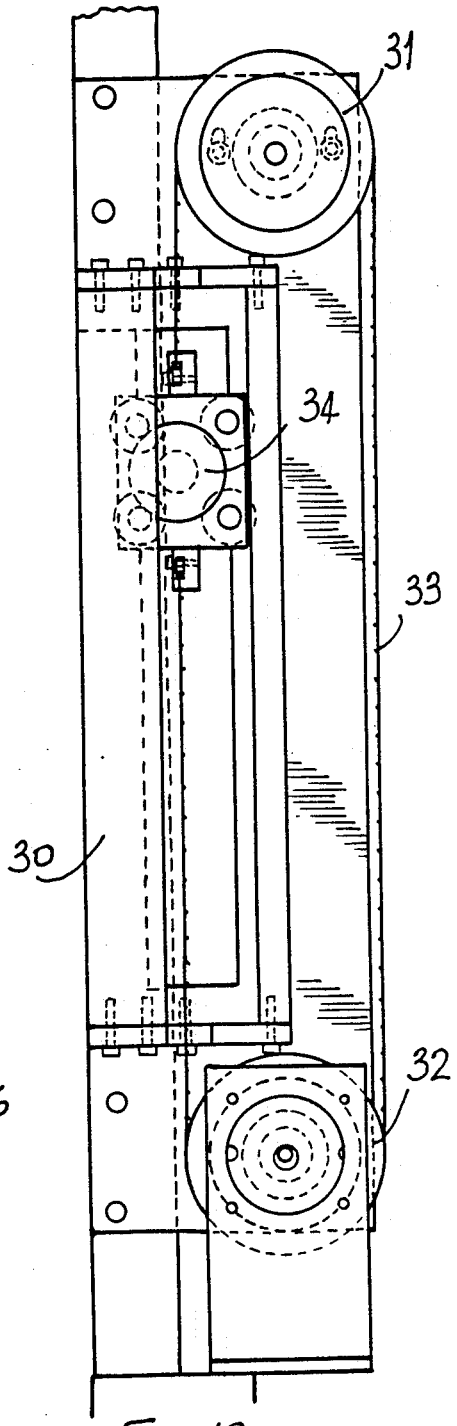
FIG. 18 is an end view of the assembly of FIG. 17 with the potentiometer removed.

Referring to FIGS. 17 and 18 there is illustrated a speed variation device for the reel rotation drive 3, in this case, a potentiometer assembly including a support frame 30 incorporating a pair of pulleys 31 and 32 supporting a belt 33. Mounted on the belt 33 is a cam follower 34 which engages the slot 27 in the arm 24. The pulley 32 is connected by a universal joint 35 to a potentiometer 36 which is electrically connected to the reel rotation drive 3.

Figure 22:
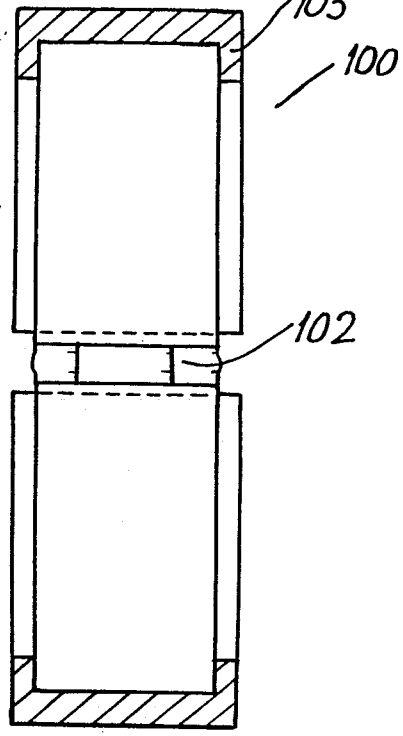
FIG. 22 is a sectional view in the direction of the arrows XXII—XXII of FIG. 21.
Figure 21:
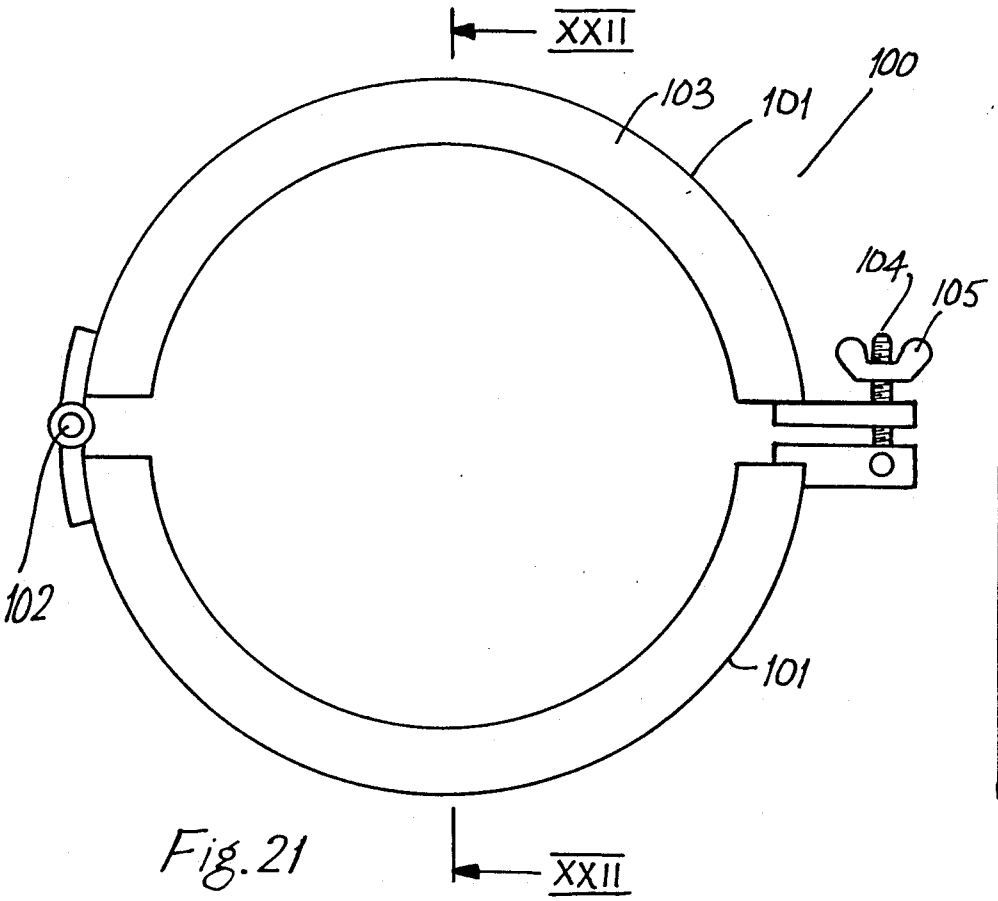
FIG. 21 is a side view of a clamp used with the invention.

The reel support 2 comprises a pair of spaced-apart arms 40 and 41 each pivotally mounted at one end on the support frame structure 10, the arm 40 incorporating a standard belt drive 42. The belt drive 42 is connected to a drive pulley, mounted at an outer end of the arm 40, on which is mounted a stub axle incorporating an end flange 43*d* which projects laterally from the outer end of the arm 40. The arms 40 and 41 support between them a shaft 43. The shaft 43 has an end flange 43*a* incorporating an axial hole 43*b* for reception of the stub axle on the arm 40. The flange 43*a* is connected by releasable dog keys to the flange 43*d* on the stub axle and the two flanges are additionally secured together by a clamp 100. The clamp 100 is illustrated in more detail in FIGS. 21 and 22. The clamp 100 comprises a pair of semi-circular flange embracing members 101 connected by a hinge 102. Each member 101 is cylindrical in cross-section having a pair of depending walls 103 for embracing the flange 43*a* and the flange 43*d* on the stub axle, the members 101 are secured together by a bolt 104 and wing nut 105. The shaft 43 can thus be readily easily mounted on and detached from the stub axle and hence the drive. The arm 41 has a split bearing 49 to allow the shaft 43 to be removed at its other end. Various portions of the reel support 2 are shown in more detail in FIGS. 5 to 13 inclusive. The shaft 43 has a plurality of holes 44 for reception of pins 45. There is provided a reel cone 46 having a bore 47 for mounting on the shaft 43. The cone 46 incorporates a straight-through hole 48 for reception of a pin 45. There is also provided an adjustable reel cone 50 having a bore 51 for reception of the shaft 43 and a larger bore 52 which incorporates a pair of keyways 53. A male adjustment screw 54 having a threaded portion 55 for reception of a lock nut 56 (see FIGS. 9 to 12) is provided and includes a bore 57 for mounting on the shaft 43. The screw 54 has a plurality of staggered straight-through holes 58 for reception of pins 45 and also incorporates keyways 60 in an outer portion 61 adapted to engage within the bore 52 of the adjustable reel cone 50. The use of keys within the keyways 53 and 60 will allow the screw 54 to move in and out of the bore 52 of the cone 50. It will be appreciated that the construction of reel cone 50 is such as to allow different sizes of reels to be mounted therebetween. The arms 40 and 41 are height adjustable by means of rams 65 only one of which is shown in FIG. 1.

Figure 14:
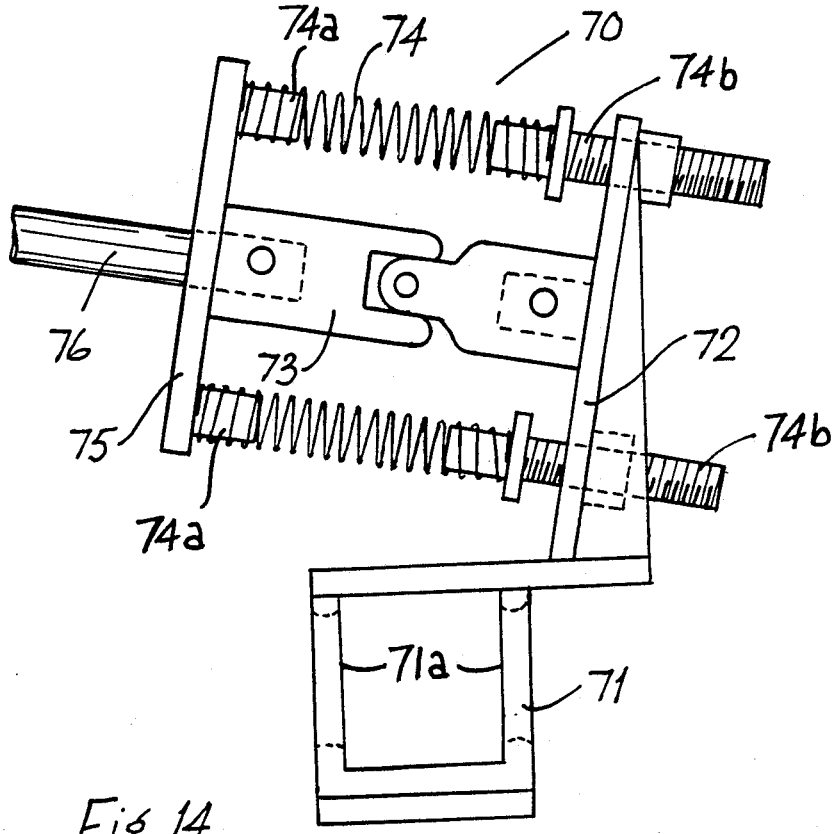
FIG. 14 is a side view of portion of a reel spooling guide of the device.
Figure 15:
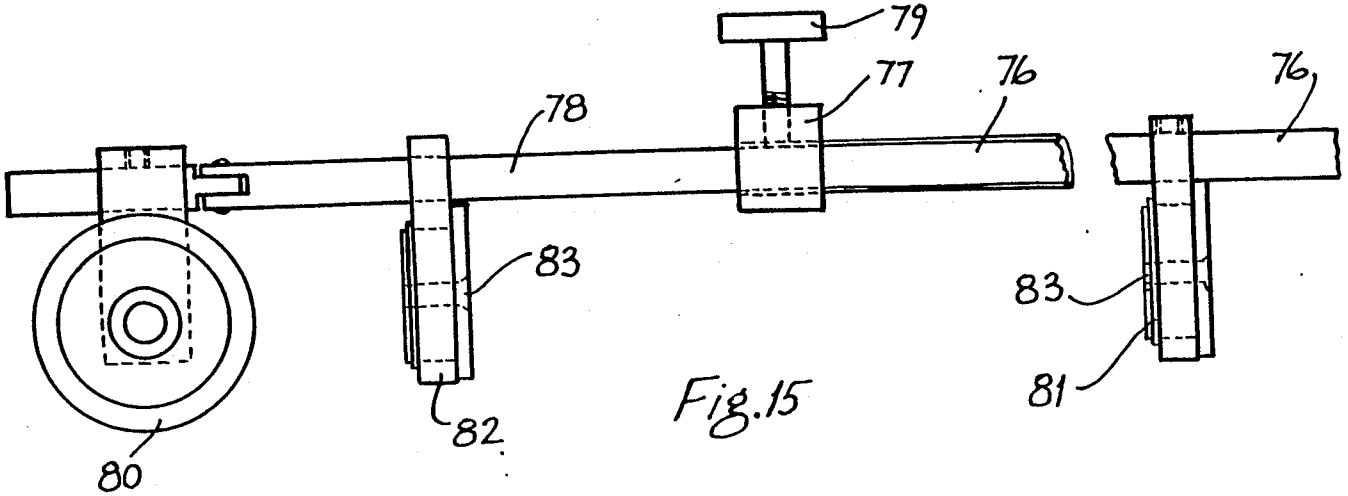
FIG. 15 is a view of a further portion of the reel spooling guide.
Figure 16:
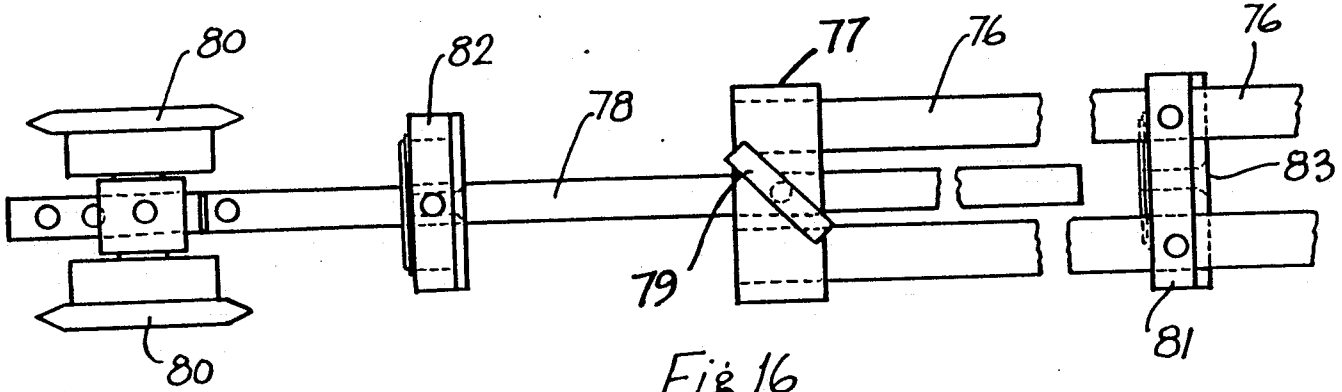
FIG. 16 is a plan view of the portion of the reel spooling guide illustrated in FIG. 15.

Referring now to FIGS. 14 to 16 there is provided a wire reel spooling guide indicated generally by the reference numeral 70 mounted on the support frame structure 10 between the pulling force measuring means 4 and the wire reel support 2, the spooling guide 70 only used when spooling wire 6 onto a reel 5. The spooling guide 70 comprises a support frame 71 having wire guide holes 71*a*. An inner mounting plate 72 is mounted on the support frame 71 and is connected by means of a universal joint 73, and a pair of spaced-apart springs 74 to an outer plate 75. It will be noted that the springs 74 are mounted one above the other on each side of the universal joint 73. Each spring 74 is mounted between a spigot 74*a* on a rear face of the outer plate 75 and a flanged bolt 74*b* which threadedly engages the inner mounting plate 72, the bolt 74*b* allowing adjustment of the tension in the spring 74. On the outer plate 75 is mounted a pair of spaced-apart arms 76 terminating in a bracket 77 on which is adjustably mounted a further arm 78 and secured thereto by a threaded locking screw 79. The arms 76 and 78 together form a cantilevered telescopic support arm. Mounted at an outer end of the arm 78 is a pair of spaced-apart guide wheels 80 each having a V-shaped periphery for engaging a wire 6 as it is wound onto a reel 5. There is a pair of wire guides namely an inner wire guide 81 and an outer wire guide 82 each having a hole 83 to accommodate a wire led therethrough. A conventional wire guide 90 (see FIG. 1) is provided on the support frame structure 10.

The reel rotation drive 3 is a conventional variable speed drive of the electro-magnetic induction type and its speed is controlled by the potentiometer 36 in conventional manner. The actual transfer of the drive gearbox etc., is again of conventional construction and doesn't require any description. There are many types of these drives, for example, one form comprises a poled rotor which is fixed to an output shaft and surrounded by a tube which is driven by a constant speed AC motor. A stationary brushless coil is held on a stator fixed to an outer casing. Magnetic flux is set up when the field coil is energised, generating currents in the tube and causing the rotor to revolve. A tachogenerator is mounted on the output shaft to give a voltage proportional to the speed. The drive may advantageously include a suitable gear box. A 20:1 reduction helical gear box has been found particularly suitable as it obviates the necessity to provide a clutch or brake. Further, the particular drive used provides constant or variable torque over a wide range of speeds.

In operation, when it is desired to dispense wire 6 from a reel 5 the reel 5 can be mounted on the shaft 43 and secured thereto by use of the reel cones 46 and 50. The wire 6 is then led through the guide 90 over the pulley 21, down under the pulley 23 and back up over the pulley 22. As wire 6 is pulled off the reel 5 on demand there is a pulling force which causes wire tension and hence a pulling force on the pulley 23. This acts on the arm 24 thus causing it to pivot upwards. As it pivots upwards the cam follower 34 is moved thus altering the potentiometer and changing the speed of rotation and hence the dispensing speed.

Figure 23:
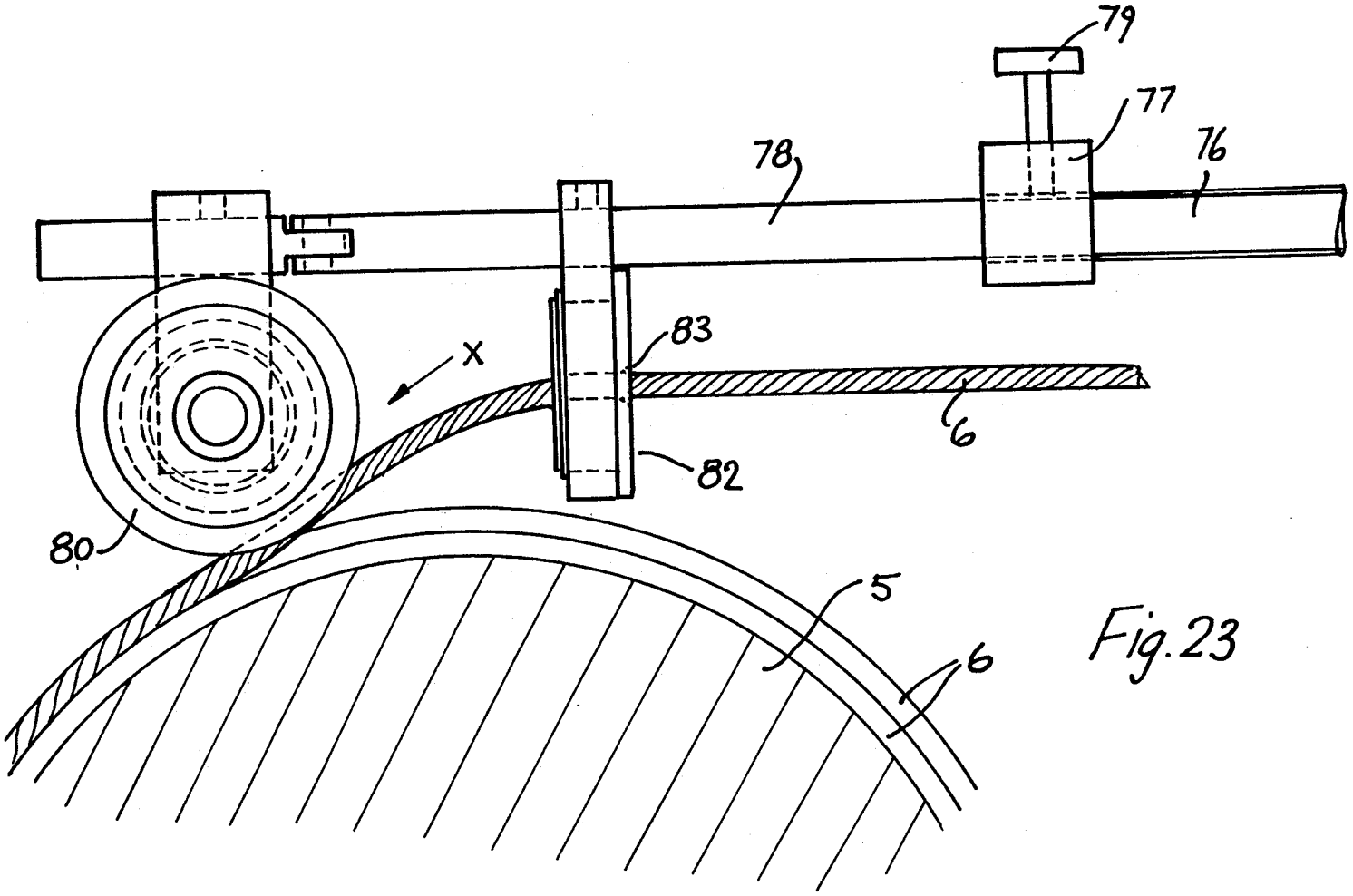
FIG. 23 is a detailed side partially sectioned view showing portion of the reel spooling guide in use spooling wire onto a reel, FIG. 24 (*a*) to FIG. 24 (*e*) are diagrammatic plan views of portion of the spooling guide showing the spooling guide in a number of different positions as it moves between each end of a reel when spooling wire onto the reel.
Figures 24A, 24B, 24C, 24D, 24E:
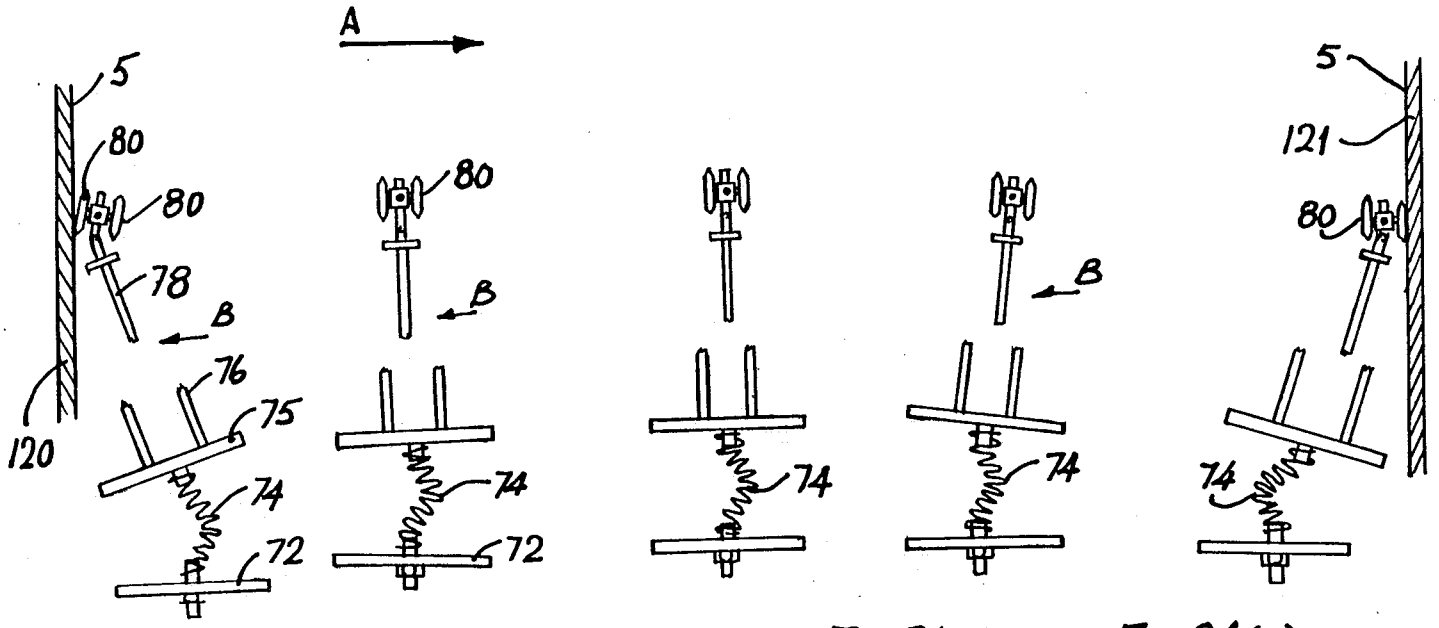
Figure 25:
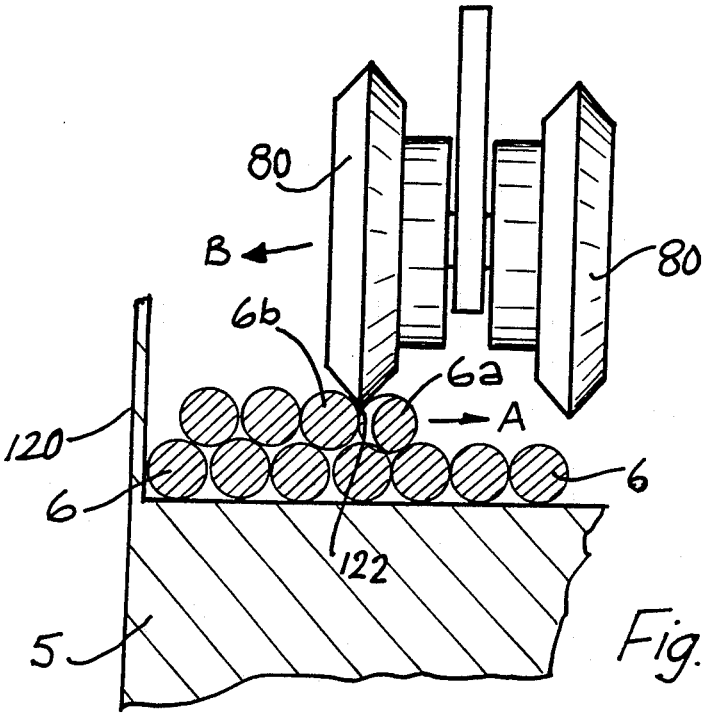
FIG. 25 is a diagrammatic partially sectioned detail view taken in the direction of arrow X of FIG. 23, showing portion of the spooling guide in use when spooling wire onto a reel, the position of the spooling guide corresponding to the position shown in FIG. 24 (*b*)
Figure 26:
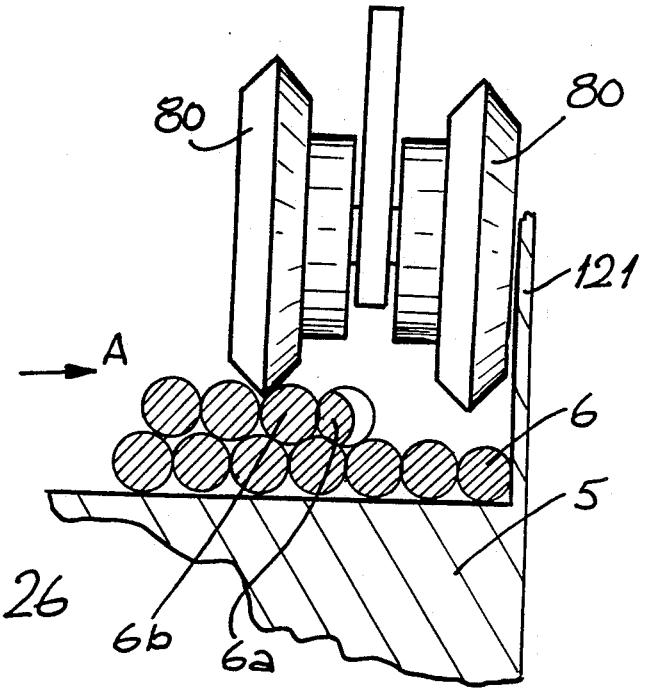
FIG. 26 is a diagrammatic partially sectioned detail view similar to FIG. 25 but showing the spooling guide portion in another position which corresponds to the position shown in FIG. 24 (*e*).

When it is desired to spool wire 6 onto a reel 5 then the wire reel spooling guide 70 is used and the drive direction is reversed. Wire is led over the pulley 22, down under the pulley 23 and back up over the pulley 21 and through the wire guide 90 and the wire guides 71*a*, 81, 82 on the spooling guide 70 and onto the reel 5 as shown in FIG. 1 and FIG. 23. FIG. 24(*a*) to FIG. 24 (*e*) shows the spooling guide 70 in a number of positions as wire 6 is wound onto the reel 5 between end flanges 120 and 121 of the reel 5 when spooling in the direction of arrow A indicated on FIGS. 24 to 26. As wire 6 is wound onto the reel 5 the left hand wheel 80 of the spooling guide 70 locates in a groove 122 formed between a coil 6*a* being laid on the reel 5 and the adjacent previously laid coil 6*b* as shown in FIG. 25, bearing against the coils 6*a*, 6*b* and running along the groove 122 following the coils across the reel 5 between the end flanges 120 and 121 of the reel 5. In the position shown in FIG. 24(*a*) the arm 78 of the spooling guide 70 is pivoted to the left and it will be noted that each spring 74 is distorted to accommodate this, spring tension thus created urging the arm 78 to the left so that the left hand wheel 80 is biased in the direction of arrow B of FIG. 25 holding the wheel 80 against the previously laid coil 6*b*. This ensures that all the previously laid coils of wire in the row are held tightly together as the next coil of wire 6*a* is laid on the reel 5. The bias in the springs 74 is maintained in the direction of arrow B until after the arm 78 passes its central position and as it continues to move further to the right the deflection of each spring 74 reverses as shown in FIG. 24 (*e*) and hence the spring bias reverses. Once the row of coils passes the central position on the reel 5 the angular feed and pull on the wire 6 itself will then hold the wire 6 against the previously laid coil as it is fed onto the reel 5. On reaching the right hand end of the reel 5, as in the position shown in FIG. 24 (*e*) and FIG. 26 the right hand wheel 80 of the spooling guide 70 will abut the end flange 121 of the reel 5 and coils of wire 6 will continue to the end flange 121 and the first coil of the next above row of coils raises the right hand wheel 80 which simultaneously lifts the left hand wheel 80 clear of the coils, and the cycle is reversed with in this case the right hand wheel 80 engaging the coils as the arm 78 moves to the left following the spooling of the next row of wire coils on the reel 5. The tension created by the toggle action of the springs 74 can be increased by adjusting the bolts 74*b* to compress the springs 74. The speed of spooling will be in direct proportion to the tension on the wire 6. The device can be so arranged in a conventional manner that when a preset tension is reached the reel 5 stops to avoid breaking the wire 6. The operation of the potentiometer has also to be reversed.

Figure 19:
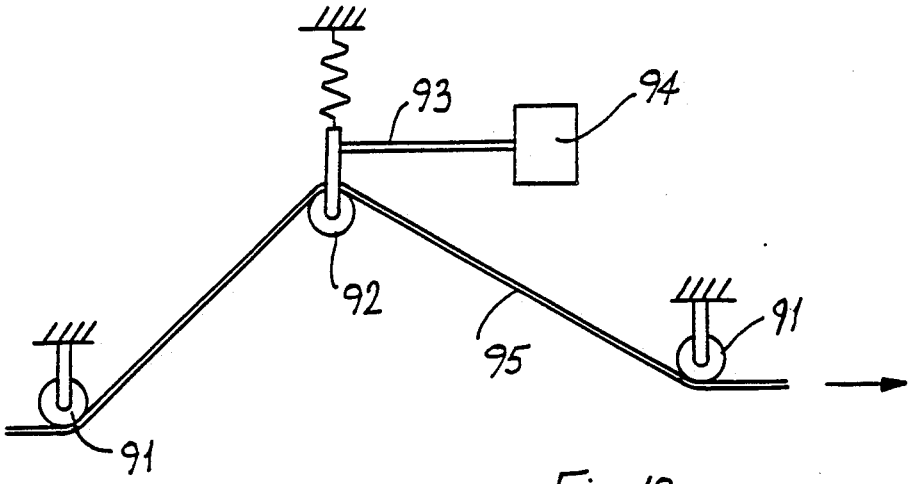
FIG. 19 is a diagrammatic view of an alternative construction of means for measuring a pulling force on a wire.

Referring to FIG. 19 there is illustrated an alternative construction is part diagrammatic form of a means for measuring the pulling force or tension in a wire 95. In this case there is illustrated a pair of fixed pulleys 91 and a spring loaded movable pulley 92 connected by an arm 93 to a potentiometer 94. Changes in tension in the wire 95 will be transmitted to the pulley 92.

Figure 20:
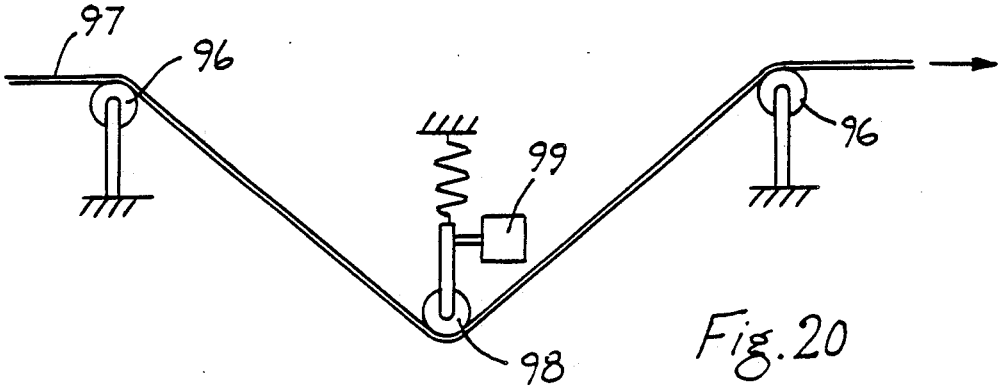
FIG. 20 is a diagrammatic view of another means for measuring the pulling force on a wire according to the invention.

Referring to FIG. 20 there is illustrated an arrangement of fixed pulleys 96, wire 97, a movable pulley 98 and potentiometer 99, arranged horizontally. It will be appreciated again that movement of the movable pulley 98 will be transmitted to a potentiometer 99. Thus, it will be appreciated that it is not necessary for the pulleys to be vertically arranged but may be arranged in any suitable way.

It will be readily appreciated by those skilled in the art that many other variations of the invention may be made.

I claim:

1. A wire reel spooling, storage and dispensing device comprising;

a support frame structure;

a wire reel support comprising a pair of spaced-apart arms each pivotally mounted at one end on the support frame structure and at the other end adapted for support of a wire reel therebetween;

means for raising and lowering the arms relative to the support frame structure;

a variable speed reel rotation drive;

means for measuring a pulling force exerted on the wire, comprising a fixed wire input guide pulley, a fixed wire output guide pulley and a movable intermediate guide pulley therebetween, offset from an in-line position as defined by a wire running directly between the two fixed pulleys, and means for biasing the intermediate guide pulley away from the in-line position between the input and the output guide pulleys against any tension in the wire which will cause the intermediate guide pulley to move towards the in-line position;

means for varying the speed of the reel rotation drive in response to the pulling force, said means being controlled by movement of the intermediate guide pulley;

and a wire reel spooling guide mounted on the support frame structure between the means for measuring a pulling force exerted on the wire and the wire reel support, the spooling guide for use when spooling wire onto a reel mounted on the reel support;

characterised in that the reel rotation drive is reversible to facilitate both spooling wire onto and dispensing wire from a reel when the reel is mounted on the reel support and further characterised in that the spooling guide has a pair of spaced-apart guide wheels for feeding wire onto a reel when spooling, the guide wheels being mounted on a cantilevered support arm, the support arm being mounted on the support frame structure by flexible connection means which comprises a pair of spaced-apart plates, namely a mounting plate secured to the support frame structure and an outer plate connected to the support arm, a universal joint and a pair of spaced-apart springs connecting said plates whereby the support arm is permitted limited movement to follow spooling of the wire.

2. A wire reel spooling, storage and dispensing device as recited in claim 1 in which the wire reel support further comprises a shaft and a driven stub axle engaged with the shaft, said shaft and stub axle being mounted between the spaced-apart arms, one of said arms incorporating a split bearing for reception of the shaft and the other of said arms incorporating said driven stub axle, the stub axle and shaft incorporating flanges which mate with each other and are engaged by a releasable clamp.

3. A wire reel spooling, storage and dispensing device as recited in claim 1 in which the reel rotation drive is an infinitely variable reel rotation drive of the electromagnetic induction type in which torque may be varied.

4. A wire reel spooling, storage and dispensing device as recited in claim 2 in which the reel rotation drive is an infinitely variable reel rotation drive of the electromagnetic induction type in which torque may be varied.

* * * * *